US007631520B2

(12) United States Patent
Yamahara et al.

(10) Patent No.: US 7,631,520 B2
(45) Date of Patent: Dec. 15, 2009

(54) INNER WEAR AND HIGH-GAUGE CIRCULAR KNITTING MACHINE, AND KNITTING METHOD USING THE HIGH-GAUGE CIRCULAR KNITTING MACHINE

(75) Inventors: Seiji Yamahara, Miyazu (JP); Takahiro Yamazaki, Okayama (JP); Takashi Maruoka, Miyazu (JP); Katsunori Matsushita, Hyogo (JP); Koji Kimura, Hyogo (JP)

(73) Assignee: Gunze Limited, Ayabe-shi, Kyoto (JP)

( * ) Notice: Subject to any disclaimer, the term of this patent is extended or adjusted under 35 U.S.C. 154(b) by 697 days.

(21) Appl. No.: 10/548,092

(22) PCT Filed: Mar. 1, 2004

(86) PCT No.: PCT/JP2004/002509

§ 371 (c)(1),
(2), (4) Date: Sep. 6, 2005

(87) PCT Pub. No.: WO2004/086889

PCT Pub. Date: Oct. 14, 2004

(65) Prior Publication Data

US 2006/0169001 A1 Aug. 3, 2006

(30) Foreign Application Priority Data

Mar. 28, 2003 (JP) ..... 2003-092341

(51) Int. Cl.
*D04B 9/06* (2006.01)

(52) U.S. Cl. ..... 66/19

(58) Field of Classification Search ..... 66/8, 66/17, 18, 22, 25, 178 R, 179, 180, 181, 182, 66/183, 184, 185
See application file for complete search history.

(56) References Cited

U.S. PATENT DOCUMENTS

| | | | | | |
|---|---|---|---|---|---|
| 3,222,889 | A | * | 12/1965 | Mischon | 66/28 |
| 3,576,115 | A | * | 4/1971 | Schmidt | 66/19 |
| 3,835,668 | A | * | 9/1974 | Schiebel et al. | 66/19 |
| 3,975,927 | A | * | 8/1976 | Mickeler et al. | 66/134 |
| 4,019,350 | A | * | 4/1977 | Schmidt | 66/196 |
| 5,359,865 | A | * | 11/1994 | So | 66/19 |
| 5,463,881 | A | * | 11/1995 | Igarashi et al. | 66/31 |
| 5,546,769 | A | * | 8/1996 | Igarashi et al. | 66/20 |
| 5,730,005 | A | * | 3/1998 | Chen | 66/151 |

FOREIGN PATENT DOCUMENTS

GB 1 436 616 5/1976

(Continued)

*Primary Examiner*—Danny Worrell
(74) *Attorney, Agent, or Firm*—Birch, Stewart, Kolasch & Birch, LLP

(57) ABSTRACT

The invention provides innerwear with a structure in which the body fabric and the hem are joined together without sewing and which has outstanding effects in discrimination as products and in showing individuality for users.

The innerwear includes a body fabric 2 made of a cylindrical double material with a body size and a hem 3 disposed at the end of the body fabric 2 and having apparently different texture therefrom, the body fabric 2 and the hem 3 being joined to each other without sewing. The body fabric 2 partly has a heterogeneously knitted part 5 with different functions, appearance, and texture therefrom by differentiating the way of knitting in the consecutive knitting process.

7 Claims, 9 Drawing Sheets

FOREIGN PATENT DOCUMENTS

| | | | | | |
|---|---|---|---|---|---|
| GB | 1436616 | A | * | 5/1976 | ..... 66/8 |
| GB | 2 076 634 | | | 12/1981 | |
| JP | 40-15459 | B1 | | 7/1965 | |
| JP | 43-30141 | Y1 | | 12/1968 | |
| JP | 46-16123 | Y1 | | 6/1971 | |
| JP | 49-80350 | A | | 8/1974 | |
| JP | 55-124486 | A | | 9/1980 | |
| JP | 56-140143 | A | | 11/1981 | |
| JP | 56-159304 | A | | 12/1981 | |
| JP | 60-259659 | A | | 12/1985 | |
| JP | 1-21988 | Y2 | | 6/1988 | |
| JP | 1-98182 | A | | 6/1989 | |
| JP | 1-44819-NB2 | | | 9/1989 | |
| JP | 1-59373 | B2 | | 12/1989 | |
| JP | 4-11055 | A | | 1/1992 | |
| JP | 5-25757 | A | | 2/1993 | |
| JP | 6-33349 | A | | 2/1994 | |
| JP | 6-81201 | A | | 3/1994 | |
| JP | 9-31708 | A | | 2/1997 | |
| JP | 3037440 | U | | 2/1997 | |
| JP | 9-95805 | A | | 4/1997 | |
| JP | 3046785 | U | | 12/1997 | |
| JP | 10-8361 | A | | 1/1998 | |
| JP | 3055424 | U | | 1/1999 | |
| JP | 2896647 | B2 | | 3/1999 | |
| JP | 11-302952 | A | | 11/1999 | |
| JP | 3178751 | B2 | | 6/2001 | |
| JP | 2001-200401 | A | | 7/2001 | |
| JP | 2002-38359 | A | | 2/2002 | |

* cited by examiner

INNER WEAR AND HIGH-GAUGE CIRCULAR KNITTING MACHINE, AND KNITTING METHOD USING THE HIGH-GAUGE CIRCULAR KNITTING MACHINE

TECHNICAL FIELD

The present invention relates to innerwear and a high-gauge circular knitting machine, and a knitting method using the high-gauge circular knitting machine.

BACKGROUND ART

A hem of bottom innerwear such as bottom wear, pants, spats, and shorts, and top innerwear such as camisoles and shirts is generally processed by turning up the body fabric and stitching it up or sewing hem tape thereon (e.g., refer to JP-A-9-31708, JP-A-6-81201, and JP-A-9-95805).

The purpose of the above processing of hems is primarily to prevent the fray of the body fabric. Other purposes include enhancement of the appearance by setting off or accentuating the hem, provision of tightening effects for wearers, and the like.

Some outerwear does not need the processing of the hems because the hems are finished integrally in the process of knitting the body fabric. The hems finished in that way have no stitched part between them and the body fabric, having no unevenness, thus being preferred due to their streamlined appearance.

However, for innerwear which uses yarn thinner (No. 30 yarn count or more) and denser (0.58 or more in cover factor) than outerwear, the integrated hem finishing in the process of knitting has been regarded as impossible in principle with an exception of the following case.

The exceptional case adopts a manufacturing method for innerwear in which continuous fabric is knitted by piece knitting using a circular knitting machine; isolation regions using melt yarn are formed between the pieces; the isolation regions are melted in downstream operation to isolate the pieces from each other; and the pieces are finished as innerwear. The use of the exceptional manufacturing method provides hems that need no subsequent processing (e.g., refer to JP-A-10-8361).

Melt yarn used to form the isolation region in the exceptional manufacturing method is formed by plying about 10 to 30 filaments of 3 to 5 deniers. In other words, one melt yarn was 30 to 150 deniers in thickness.

In many cases, circular knitting machines have been used to knit the fabric for innerwear. Accordingly, the knitted fabric is cylindrical fabric.

The circular knitting machines have a cylindrical cylinder and a disc-shaped dial disposed on the cylinder. Around the cylinder are provided a large number of cylinder needles with the length direction thereof oriented vertically; on the upper surface of the dial are provided a large number of dial needles radially with the length direction thereof oriented in the radial direction (e.g., refer to JP-A-2002-38359, JP-A-4-11055, JP-A-6-33349, and JP-A-5-25757).

The cylinder needles and the dial needles rotate with the rotation of the cylinder and the dial to knit double-material cylindrical fabric (a fabric having the same knitted structure on both sides thereof) by vertical motion of the cylinder needles and the to-and-fro motion of the dial needles.

The knitted cylindrical fabric is hung downward along the inside of the cylinder and is wound in a roll to be wound with a specified torque by a winder disposed under the cylinder (e.g., refer to JP-B-1-44819 and JP-B-1-59373).

Of such circular knitting machines, those for innerwear are called high-gauge circular knitting machines because of dense knitting with thin yarn. High gauge generally denotes 17 gauges or more. The 17 gauges indicates that 17 or more cylinder needles are contained in one inch. Incidentally, circular knitting machines of less than 17 gauges are referred to as low-gauge circular knitting machines. The low-gauge circular knitting machines are often used to knit outerwear.

In conventional innerwear, however, body fabric is generally folded up and stitched or hem tape is sewn thereon to process hems thereof, resulting in, in most cases, projecting lines along the stitch, steps due to piling, or visible seams between the body fabric and the hem.

Accordingly, with such innerwear on, the boundary between the body fabric and the hem comes out to outerwear, which can be viewed from the outside, providing bad appearance. Also, from the nature of innerwear, the projecting lines, the steps, or the seams come into direct contact with skins and provide a harsh texture, decreasing the comfortability.

The time consuming work to finish the hems has been a stumbling block in increasing the productivity of innerwear and decreasing the cost.

The foregoing exceptional innerwear manufacturing method in which fabric is separated by the isolation region made of melt yarn does not require the time consuming work to finish the hems. However, it has the following problem.

The melt yarn used for the isolation regions must be as thick as 30 to 150 deniers. This is because yarn without those thicknesses has insufficient strength for knitting with conventional high-gauge circular knitting machines and causes yarn breakage.

However, the isolation regions, although made of melt yarn, sometimes remain slightly on the hem side after being melted for isolation. Accordingly, with the above-mentioned thick melt yarn, the end of the melt yarn remaining on the hem side sometimes causes coarse texture. This also sometimes decreased the comfortability of innerwear.

Moreover, in most of the conventional innerwear, since the entire body fabric is made of a single knitted structure, there has been no product having, for example, various functions such as moisture retention and body correction, appearance in which patterns and designs, texture, or the like are varied only in part of the body fabric. This poses the disadvantages of difficulty in providing products having discriminating features for sellers and in obtaining products showing individuality for users.

This was caused by the fact that the conventional high-gauge circular knitting machines used to knit innerwear cannot be equipped with a yarn-feeding changeover switch. Even if the conventional high-gauge circular knitting machines is equipped with a yarn-feeding changeover switch, a phenomenon occurs in which the knitting operation does not make progress (or knitting can not be made) at all even if the fabric is drawn by a winder. The reason for the phenomenon has not been clarified at all.

The present invention has been made in light of such circumstances, and has as an object of providing innerwear which has good appearance, texture, and comfortability.

The invention has another object of providing innerwear which has outstanding effects in discrimination as products and in showing individuality for users by providing different functions, appearance, and texture in part of the body fabric.

The invention has still another object of providing a high-gauge circular knitting machine and a knitting method using the high-gauge circular knitting machine capable of knitting innerwear, easily, reliably, and with high productivity, the innerwear having good appearance, texture, and comfortability and the innerwear having different functions, appearance, and texture in part of the body fabric to provide outstanding effects in discrimination as products and in showing individuality for users.

DISCLOSURE OF THE INVENTION

In order to achieve the above-described objects, the present invention has taken the following means.

Innerwear according to the invention includes body fabric made of a cylindrical double material with a body size and a hem disposed at the end of the body fabric and having apparently different texture therefrom. The body fabric and the hem are joined to each other without sewing (seamless).

Specifically, since the hem is neither formed by folding the body fabric up and sewing nor by sewing hem tape thereon, no projecting line, no step due to piling, or no visible seam appears between the body fabric and the hem.

Accordingly, with the innerwear on, the boundary between the body fabric and the hem exerts no bad influence on outerwear, having no possibility of deteriorating the appearance. Since there are no projecting line, no step, and no seam, the comfortability is not decreased because of those. Also, since there is no need for the time and labor to finish the hem, the productivity as innerwear can be increased and the production cost can be reduced.

The innerwear according to the invention may be constructed such that the body fabric partly has a heterogeneously knitted part with different functions, appearance, and texture therefrom formed by differentiating the way of knitting in a consecutive knitting process. Such innerwear is a milestone that has not been produced.

The innerwear according to the invention may be constructed such that the body fabric partly has a heterogeneously knitted part with different functions, appearance, and texture therefrom formed by differentiating the kind of yarn in a consecutive knitting process. Such innerwear is a milestone that has not been produced.

The innerwear according to the invention may be constructed such that the body fabric partly or entirely has a Jacquard pattern formed in a consecutive knitting process. Such innerwear is a milestone that has not been produced.

The innerwear according to the invention may be constructed such that the body fabric is knitted of yarn of at least No. 40 count such that the cover factor is at least 0.60. Such a numerical specification is a necessary condition as a premise for innerwear (or not being outerwear).

The innerwear according to the invention is preferably constructed such that the hem has a separated end formed by separating an isolation region formed of melt yarn of less than 30 deniers in the process of knitting continuous fabric by piece knitting.

With such an isolation region, the melt yarn at the separated end of the hem formed by isolation in the downstream process will be less than 30 deniers in thickness, even if the end of the melt yarn remains. Accordingly, the end of the melt yarn remaining on the hem does not cause coarse texture, so that the comfortability of the innerwear is not decreased.

The innerwear according to the invention has good appearance, texture, and comfortability, as described above. Also, the innerwear according to the invention has outstanding effects in discrimination as products and in showing individuality for users by providing different functions, appearance, and texture in part of the body fabric.

A high-gauge circular knitting machine according to the invention knits double-material cylindrical fabric with cylinder needles disposed around a cylinder so as to move vertically into and out from the upper circumference of the cylinder and dial needles disposed on the upper surface of the dial on the cylinder so as to move back and forth into and out from the outer circumference thereof. The knitting machine includes a yarn-feeding changeover switch that allows yarns fed to a knitting position between the cylinder needle and the dial needle to be changed during knitting. The invention further includes needle-operation control means as a premise for such high-gauge circular knitting machine.

The needle-operation control means is used to move the cylinder needle, which is on standby in a down position, up to a floating position and to keep the cylinder needle waiting in the floating position in the process in which the dial needle releases a formed dial-side loop by backward movement and then moves forward. The provision of such needle-operation control means allows the cylindrical fabric being knitted to have a downward drawing allowance. This provides the cylindrical fabric itself with a motional allowance (a relaxed state in which the fabric is free from the motion of the dial needle).

Accordingly, the application of a downward drawing force toward the lower part of the cylinder to the knitted cylindrical fabric allows reliable knitting to be continued. This is advantageous in providing a yarn-feeding changeover switch and operating it in practice.

This allows the yarn-feeding changeover switch to set melt yarn. Consequently, the high-gauge circular knitting machine can knit continuous fabric by piece knitting via an isolation region formed of melt yarn. With such an isolation region made of melt yarn, seamless innerwear can be knitted which has no projecting line along the stitch between the body fabric and the hem, no step due to piling or no visible seam.

Accordingly, with such innerwear on, the boundary between the body fabric and the hem exerts no bad influence on outerwear, providing good appearance, texture, and comfortability.

A concrete example of the needle-operation control means is a cylinder cam for controlling the vertical motion of the cylinder needles. The cylinder cam is disposed in the cylinder. In this case, the cylinder cam may adopt a cam shape that allows the cylinder needles to stand by in the floating position.

The high-gauge circular knitting machine according to the invention may include the following needle selection system. Specifically, in the needle selection system, the cylinder needle is associated with a jack in the position facing the lower end of the cylinder needle, in which the upward movement and the height of the upper destination of the cylinder needle can be switched by varying the vertical behavior of the jack.

Preferably, the needle-operation control means has a structure to keep the cylinder needle waiting in the floating position, and then temporarily move the cylinder needle downward ahead of the start of the upward motion in the following cycle, thereby reliably returning the jack in position by the downward motion of the cylinder needle. This is a remedy in case of displacement (shortage in downward motion or the like) of the jack due to whirling or the like as the cylinder needle is kept waiting in the floating position.

The high-gauge circular knitting machine according to the invention may include the following winder. The winder is used to pull down cylindrical fabric knitted in a knitting position between the cylinder needles and the dial needles to the lower part of the cylinder to wind it. Preferably, the winder includes a torque controller that varies the winding torque depending on the operating condition of the needle selection system.

The torque controller is principally used to control the winding torque such that when the needle selection system sets the number of the cylinder needles for knitting small, the winding torque is decreased, and when it sets the number of the cylinder needles large, the winding torque is increased. This is a remedy to prevent yarn breakage particularly when the number of cylinder needles is set small.

It is also evidently possible for the torque controller to prevent yarn breakage by controlling so as to decrease the winding torque when thin yarn or easy-to-break yarn in terms of strength is selected by the operation of the yarn-feeding changeover switch.

A knitting method using the high-gauge circular knitting machine according to the invention is capable of changing yarn to be fed to a knitting position as necessary while knitting double-material cylindrical fabric with cylinder needles that move vertically and dial needles that move back and forth at a level that allows crossing the upper end of the cylinder needles. Depending on the situation in the process in which the dial needle releases a formed dial-side loop by backward motion and then moves forward, the operation progresses as follows. That is, when the cylinder needle stands by in a down position, the cylinder needle is moved upward to a floating position; when the cylinder needle is in a floating position, the cylinder needle is kept in the floating position.

Thus the cylindrical fabric being knitted is given a downward drawing allowance. This provides the cylindrical fabric itself with a motional allowance (a relaxed state in which the fabric is free from the motion of the dial needle).

As described above, the high-gauge circular knitting machine and the knitting method using the same according to the invention can knit innerwear which has good appearance, texture, and comfortability, and innerwear which has different functions, appearance, and texture in part of the body fabric providing outstanding effects in discrimination as products and in showing individuality for users easily, reliably, and with high productivity.

BEST MODE FOR CARRYING OUT THE INVENTION

Embodiments of the present invention will be described hereinbelow with reference to the drawings.

Figure 1:
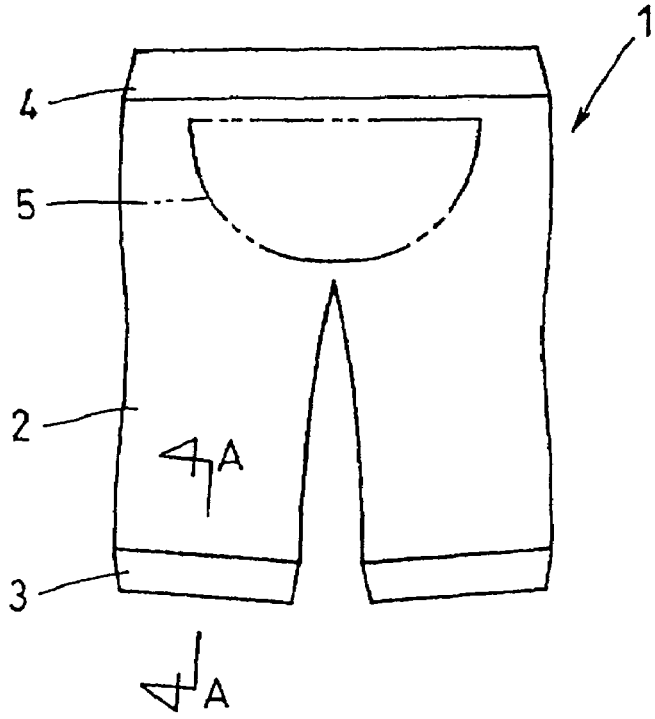
FIG. 1 is a front view of innerwear according to a first embodiment of the invention.
Figure 2:
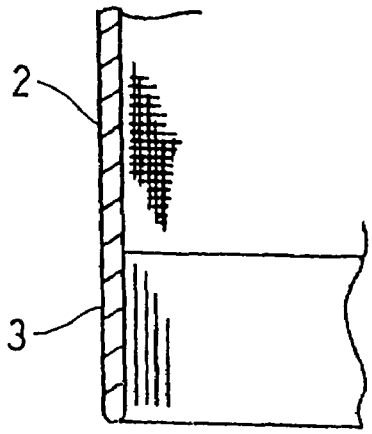
FIG. 2 is an enlarged cross-sectional view taken along line A-A of FIG. 1.

FIGS. 1 and 2 show innerwear 1 according to a first embodiment of the invention. The innerwear 1 according to the first embodiment is bottom wear.

The innerwear 1 has a body fabric 2 serving as a main body and a hem 3 provided as one of end process for the body fabric 2. Since the first embodiment is bottom wear, the hem 3 corresponds to the ends of both legs.

While a rubber belt 4 is provided around the opening of the waist, the rubber belt 4 may also be included in the concept of the hem 3.

The body fabric 2 is formed from cylindrical fabric. The size of the cylinder equals to a size of a human body, corresponding to the waist measurement of a standard body shape (there are several standard sizes for grown-up men and women and children) without pinching the width or sewing. The cylindrical fabric itself is a double material (a fabric having the same knitted structure on both sides thereof).

The body fabric 2 is knitted of yarn of No. 40 count or more to satisfy the comfortability as innerwear, which means that the thickness of yarn is equal to or less than that of the yarn of No. 40 count (corresponding to approximately 133 deniers), since the larger the yarn count is, the thinner the yarn is.

In addition, the body fabric 2 is knitted such that its cover factor is 0.60 or more. The cover factor is a factor indicative of the coarseness of knitted fabric, the value of which is denoted by K and determined by a formula of $K=1/(L\times\sqrt{\text{English cotton count}})$, where L is a loop length in the unit of cm.

Accordingly, the density of stitch of the fabric is equal to or denser than 0.60, because the larger the cover factor is, the denser the stitch is.

The hem 3 is provided at the end of the body fabric 2, as described above, and has distinctly different texture from that of the body fabric 2. In other words, the body fabric 2 and the hem 3 can be distinguished at a glance of the innerwear 1.

The method for thus differentiating the texture of the hem 3 from the body fabric 2 is achieved by differentiating the knitted structure and the yarn to be used (thickness, material, color, etc.) from that of the body fabric 2.

For example, as shown in FIG. 2, the body fabric 2 has a dense grid knitted structure, while the hem 3 has a knitted structure which has obvious vertical lines and provides high lateral stretch.

In the innerwear 1 having the body fabric 2 and the hem 3, the body fabric 2 and the hem 3 are produced differently by switching a knitting method required for the body fabric 2 and a knitting method required for the hem 3 at a specified point in time in a continuous knitting process.

The body fabric 2 and the hem 3 thus have a seamless joint structure. Specifically, since the hem 3 is neither formed by folding the body fabric 2 up nor by sewing hem tape thereon, no projecting line due to sewing, no step due to piling, or no visible seam appears between the body fabric 2 and the hem 3.

Accordingly, with the innerwear 1 on, the boundary between the body fabric 2 and the hem 3 exerts no bad influence on outerwear (not shown), having no possibility of deteriorating the appearance.

Since there are no projecting line, no step, and no seam, the comfortability is not decreased because of those. Also, since the hem 3 is knitted concurrently with the body fabric 2, there is no need for the time and labor for finishing, allowing increase in productivity of the innerwear 1 and decrease in production costs.

Figure 6:
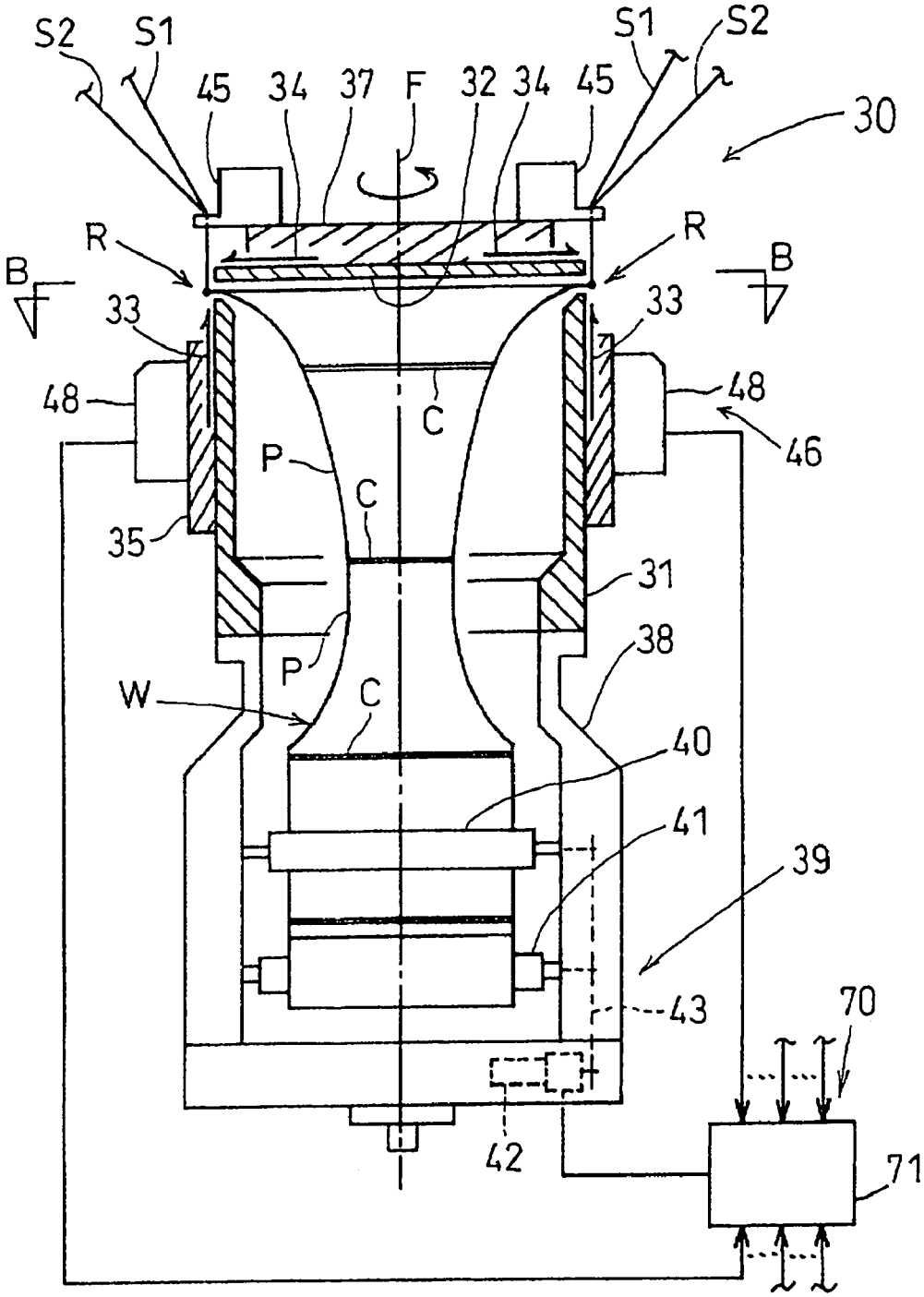
FIG. 6 is a schematic front sectional view of a high-gauge circular knitting machine according to an embodiment of the invention.

As shown in FIG. 6, the cylindrical fabric for the innerwear 1 is knitted as piece-knitted continuous fabric W.

Specifically, pieces P continue to each other via a narrow-width isolation region C, and each piece P has a sum length of the body fabric 2 and the hem 3 (including the rubber belt 4 as necessary) to be finished as one innerwear 1. The isolation region C is knitted of melt yarn.

Accordingly, when the continuous fabric W knitted in this way is heated to a specified temperature or more in downstream process, the isolation region C is melted to separate the pieces P from each other. The pieces P thus separated are then finished individually as the innerwear 1 in the following process.

The isolation region C, although made of melt yarn, sometimes remains slightly even after being melted for isolation. That is, the melt yarn remains at the hem 3 because the isolation region C is necessarily located in a position in contact with the hem 3.

It is therefore preferable to use a yarn of less than 30 deniers as the melt yarn to be used for knitting the isolation region C. For example, a 20-denier yarn is used in the first embodiment. The isolation region C made of such thin melt yarn does not cause the end of the remaining melt yarn to have coarse texture at the opening end of the hem 3 (the end produced by isolation) during the isolation (during the melting of the melt yarn). Accordingly the comfortability of the innerwear 1 is not decreased because of the separated end.

The innerwear 1 according to the first embodiment has a heterogeneously knitted part 5 in part of the body fabric 2. The heterogeneously knitted part 5 has different functions, appearance, and texture from the surrounding part.

To form the heterogeneously knitted part 5, a method of differentiating the way of knitting the corresponding part in the consecutive knitting process for the body fabric 2 is employed. For example, the body fabric 2 is knitted in principle, while only the heterogeneously knitted part 5 is knitted in tuck-stitch or knitted with miss loop portions incorporated therein densely or dispersedly.

The innerwear 1 according to the first embodiment has a wide heterogeneously knitted part 5 in a position corresponding to the part that covers the lower abdominal region of the wearer, thereby increasing the heat retaining property of the heterogeneously knitted part 5.

The location, width, shape, and purpose of the heterogeneously knitted part 5 are not limited, but it is also possible to dispose the heterogeneously knitted part 5 for increasing the breathability (cooling ability) in the part of the body fabric 2 corresponding to the both thighs and the buttocks of the wearer. It is also possible to provide the heterogeneously knitted part 5 for increasing the stretch (body shape correcting ability) in the part of the body fabric 2 corresponding to regions to be corrected.

Figure 3:
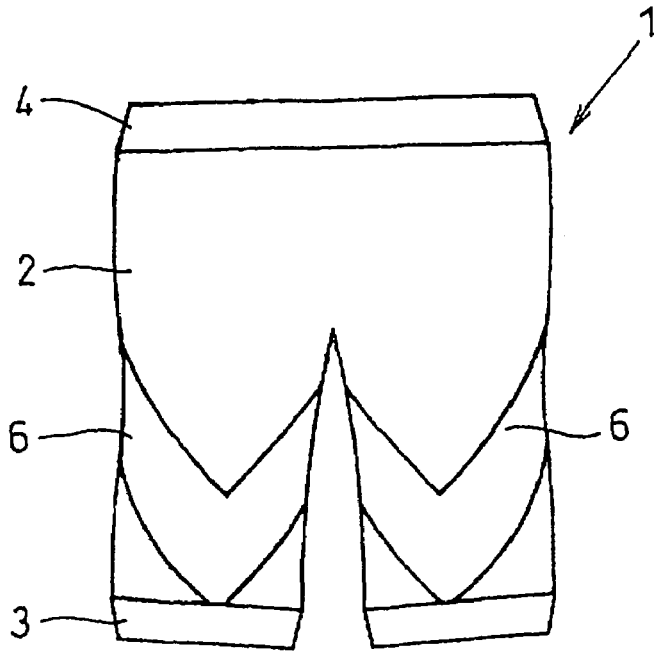
FIG. 3 is a front view of innerwear according to a second embodiment of the invention.

FIG. 3 shows innerwear 1 according to a second embodiment of the invention. The innerwear 1 according to the second embodiment is also bottom wear.

For the innerwear 1 according to the second embodiment, a heterogeneously knitted part 6 is located in V-shape in correspondence with the above-knee regions of the both thighs of the wearer. The heterogeneously knitted part 6 further has different functions, appearance, and texture from the surrounding part. To form the heterogeneously knitted part 6, a method of partly differentiating the kind of yarn to be used for the corresponding part in the consecutive knitting process for the body fabric 2 is adopted. The heterogeneously knitted part 6 is thus different in that point from the heterogeneously knitted part 5 according to the first embodiment.

The location, width, shape, and purpose of the heterogeneously knitted part 6 are not limited at all.

Figure 4:
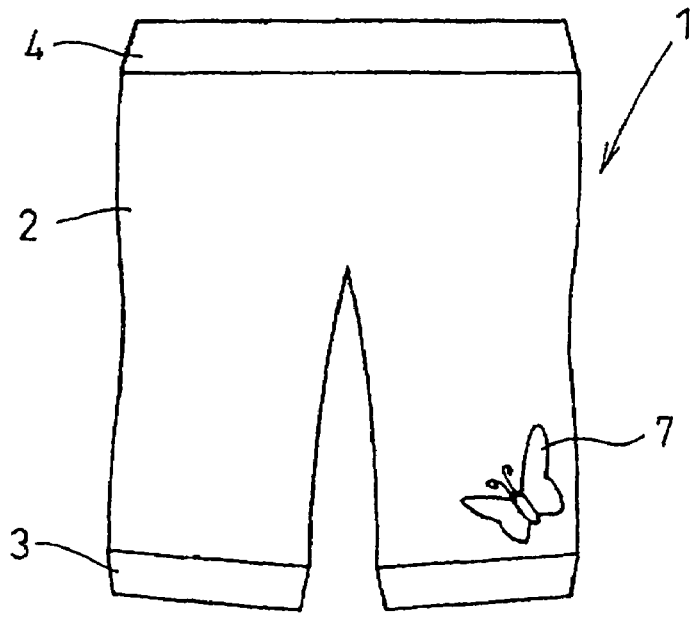
FIG. 4 is a front view of innerwear according to a third embodiment of the invention.

FIG. 4 shows innerwear 1 according to a third embodiment of the invention. The innerwear 1 according to the third embodiment is also bottom wear.

For the innerwear 1 according to the third embodiment, a Jacquard pattern 7 is located in a position close to one of the hems 3. The Jacquard pattern 7 is differentiated in the way of knitting and the kind of yarn to a desired pattern in the consecutive knitting process for the body fabric 2.

The location, width, shape, and purpose of the Jacquard pattern 7 are not limited at all. Although a butterfly design is shown in the drawing, the design of the Jacquard pattern portion may be, for example, characters, geometrical patterns, letters, or graphics. Alternatively, the entire surface of the body fabric 2 may be formed in the Jacquard pattern 7.

Figure 5:
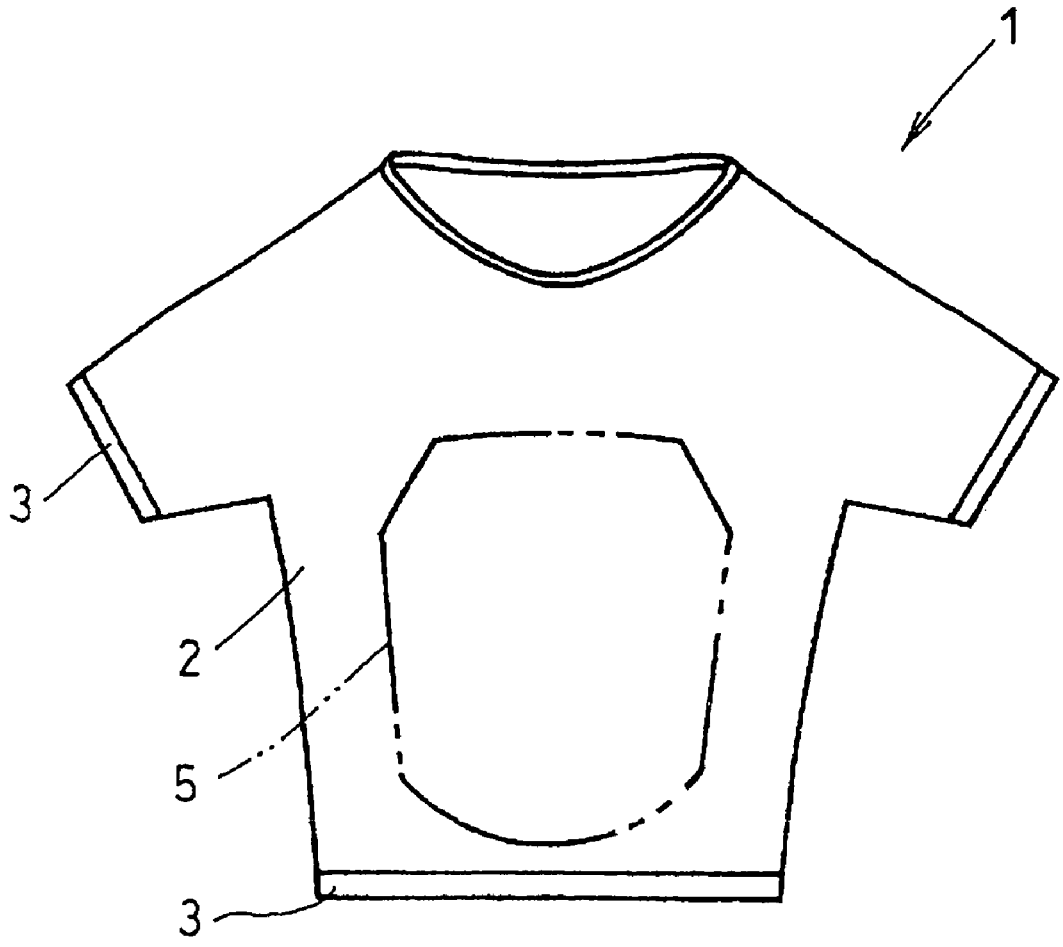
FIG. 5 is a front view of innerwear according to a fourth embodiment of the invention.

FIG. 5 shows innerwear 1 according to a fourth embodiment of the invention. The innerwear 1 according to the fourth embodiment is a shirt.

The fourth embodiment is principally the same as the innerwear 1 according to the first embodiment except that the body fabric 2 is shaped to a shirt, that the hem 3 corresponds to the part to surround the waist of the wearer, and that the heterogeneously knitted part 5 is located to cover the entire abdominal region of the wearer.

The innerwear 1 according to the invention can be achieved in any clothes irrespective of bottoms such as bottom wear, pants (for men and women), spats, and shorts, tops such as camisoles and shirts, a health band and so forth.

FIGS. 6 to 11 show a high-gauge circular knitting machine 30 according to an embodiment of the invention.

Referring first to FIG. 6, the outline of the high-gauge circular knitting machine 30 will be described. The high-gauge circular knitting machine 30 can knit the continuous fabric W (cylindrical fabric in piece knit structure) for finishing the innerwear 1 according to the first to fourth embodiments.

The body fabric 2 of the innerwear 1 according to the first to fourth embodiments is a double material (a fabric having the same knitted structure on both sides thereof), as described above. Accordingly, the high-gauge circular knitting machine 30 includes a cylindrical cylinder 31 and a disc-shaped dial 32 disposed on the cylinder 31. Around the cylinder 31 are provided a large number of cylinder needles 33 with their length direction oriented vertically; on the upper surface of the dial 32 are provided a large number of dial needles 34 radially with their length direction oriented in the radial direction.

Since the body fabric 2 of the innerwear 1 has No. 40 yarn count or more and a cover factor of 0.60 or more, the high-gauge circular knitting machine 30 is literally for high gauges (17 gauges or more, or the number of cylinder needles 33 contained in one inch is 17 or more).

The cylinder 31 and the dial 32 are rotated by a rotation drive unit (not shown) around axial center F. A lower cam block 35 is disposed around the circumference of the cylinder 31. Around the inner circumference of the lower cam block 35 is provided a cylinder cam (refer to numeral 36 in FIG. 7) for moving the cylinder needles 33 vertically. An upper cam block 37 is disposed on the dial 32. On the lower surface of the upper cam block 37 is provided a dial cam (not shown) for moving the dial needles 34 back and forth.

Accordingly, when the cylinder 31 and the dial 32 are rotated, also the cylinder needles 33 and the dial needles 34 are rotated around the axial center F, and the cylinder needles 33 are moved vertically at a specified timing by the cylinder cam 36, while the dial needles 34 are moved back and forth at a specified timing by the dial cam (not shown).

A reapproached position where the cylinder needles 33 rises and the dial needles 34 moves forward is a knitting position R, and yarn is fed to the knitting position R by a yarn feeding device (not shown). Thus the continuous fabric W is knitted with the knitting position R as the starting position. Although not shown, the knitting position R is disposed in multiple locations around the upper circumference of the cylinder 31. Therefore, multiple units of the yarn feeding devices are disposed at least one for each knitting position R.

The knitted continuous fabric W is hung down along the inside of the cylinder 31. A winder 39 is disposed at the lower part of the cylinder 31 via a hanging frame 38. The winder 39 has a set of two pinch rollers 40 and a winding roller 41 therebelow, which are driven by a winding motor 42 via transmission means 43 such as a chain and a gear train. The continuous fabric W that is knitted and brought into hung state is wound in a roll around the winding roller 41.

The structure of the high-gauge circular knitting machine 30 that is unique to the invention will be described.

The high-gauge circular knitting machine 30 includes a yarn-feeding changeover switch 45. The yarn-feeding changeover switch 45 allows changeover between yarns S1 and S2 during a continuous knitting operation when the plurality of yarns S1 and S2 can be fed to each knitting positions R (that is, when multiple yarn feeding devices are assigned to one knitting position R).

Figure 7:
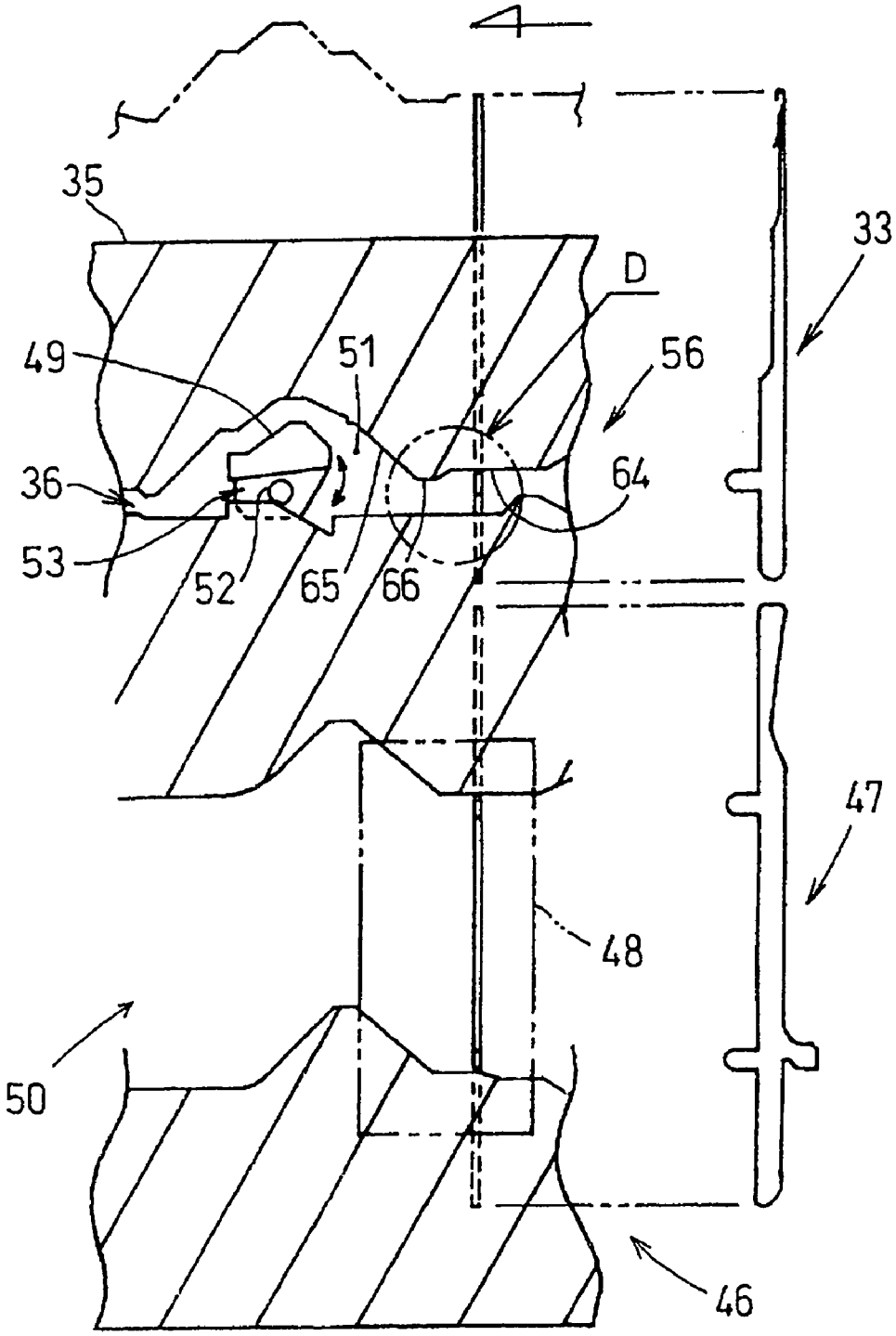
FIG. 7 is a cross-sectional view of a lower cam block, in the position where a cylinder cam and a needle selection cam appear, illustrating a state in which a cylinder needle and a jack are mounted.

The high-gauge circular knitting machine 30 further has a needle selection system 46. As shown in FIG. 7, the needle selection system 46 includes jacks 47 disposed in a one-to-one correspondence with the cylinder needles 33 and needle selectors 48 for switching on and off of the vertical motion of the jacks 47 as necessary. The needle selection system 46 further has a swing cam 49.

The jack 47 is arranged such that the upper end faces the lower end of the cylinder needle 33. When the jack 47 moves upward over a specified length, it pushes up the cylinder needle 33 therewith. The jacks 47 move vertically under the control of a needle selection cam 50 disposed along the lower part of the cylinder cam 36 on the inner circumference of the lower cam block 35. However, when the needle selectors 48 are operated, the jacks 47 are drawn out to a position where they are not controlled to move vertically by the needle selection cam 50 (radially outward from the cylinder 31), thus not moving vertically irrespective of the shape of the needle selection cam 50.

While a fluid-pressure cylinder, a solenoid, and so forth may be adopted as the needle selector 48, it is preferable to adopt a fluid-pressure cylinder in terms of eliminating magnetizing influence on peripheral devices.

In other words, the cylinder needles 33 are pushed up or not pushed up, in accordance with the jacks 47 which are moved vertically by the needle selection cam 50 or not moved vertically by the operation of the needle selectors 48.

The swing cam 49 is disposed in space 51 which vertically extends at the middle of the circumference of the cylinder cam 36 that moves the cylinder needles 33 vertically, and can be swung around a swing shaft 52. The back (upper part) of the swing cam 49 is formed in cam shape and can be varied in inclination depending on the presence of swing, thereby allowing the upper destination of the cylinder needles 33 to be switched to high or middle. At the lower part of the swing cam 49 is provided an empty passage 53.

In this needle selection system 46, as described above, when the jacks 47 are moved up by the needle selection cam 50, the cylinder needles 33 are pushed up to reach a high or middle position depending on the inclination of the swing cam 49. When the jacks 47 are brought out of engagement with the needle selection cam 50 by the needle selectors 48 not to rise, the cylinder needles 33 are also not pushed up, so that the cylinder needles 33 pass through the empty passage 53 not to be operated by the swing cam 49. As a result, also the cylinder needles 33 are not moved up.

Accordingly, the cylinder needles 33 are moved to a knit forming position when moved to a high position, to a tack knitting position at a middle position, and to a welt (miss loop generating) position when not moved up.

Figure 8:
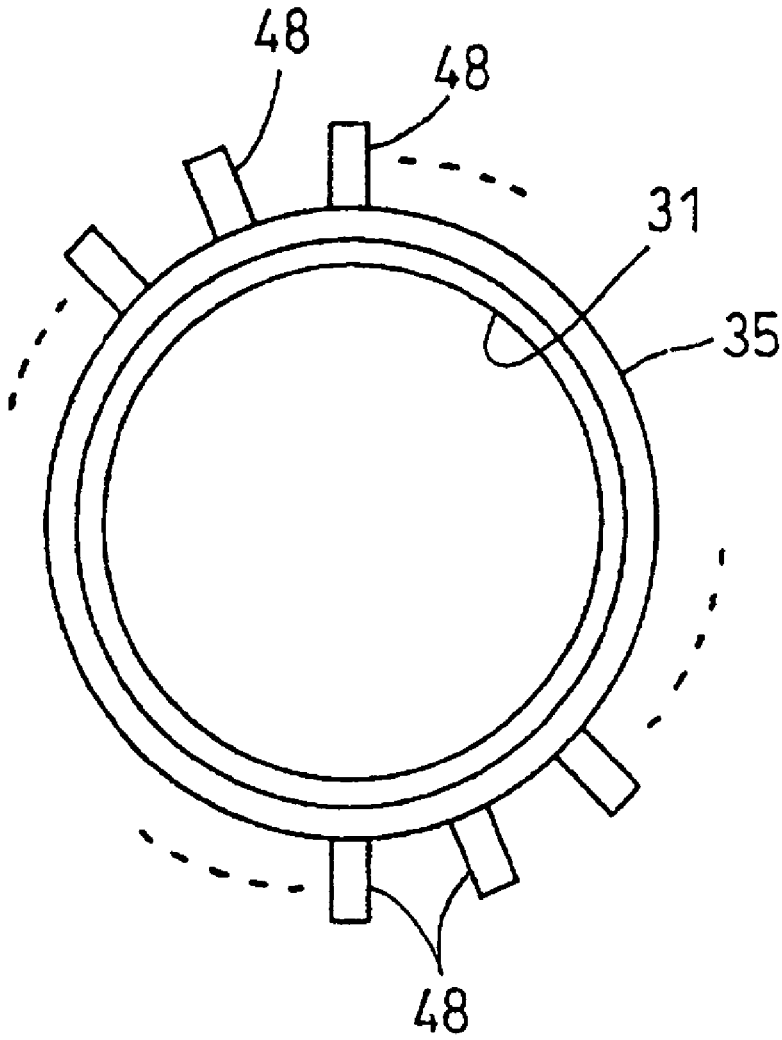
FIG. 8 is a diagram taken along arrow B-B of FIG. 6.

As shown in FIG. 8, the needle selectors 48 are disposed on multiple locations around the circumference of the cylinder 31 and the lower cam block 35. The high-gauge circular knitting machine 30 further includes needle-operation control means 56.

According to the embodiment, the cam shape of the cylinder cam 36 is provided as the needle-operation control means 56. Specifically, the cylinder cam 36 employs the cam shape that allows the cylinder needles 33 to be brought into floating state at a specified timing, and to temporarily stand by in this floating state.

Figure 9:
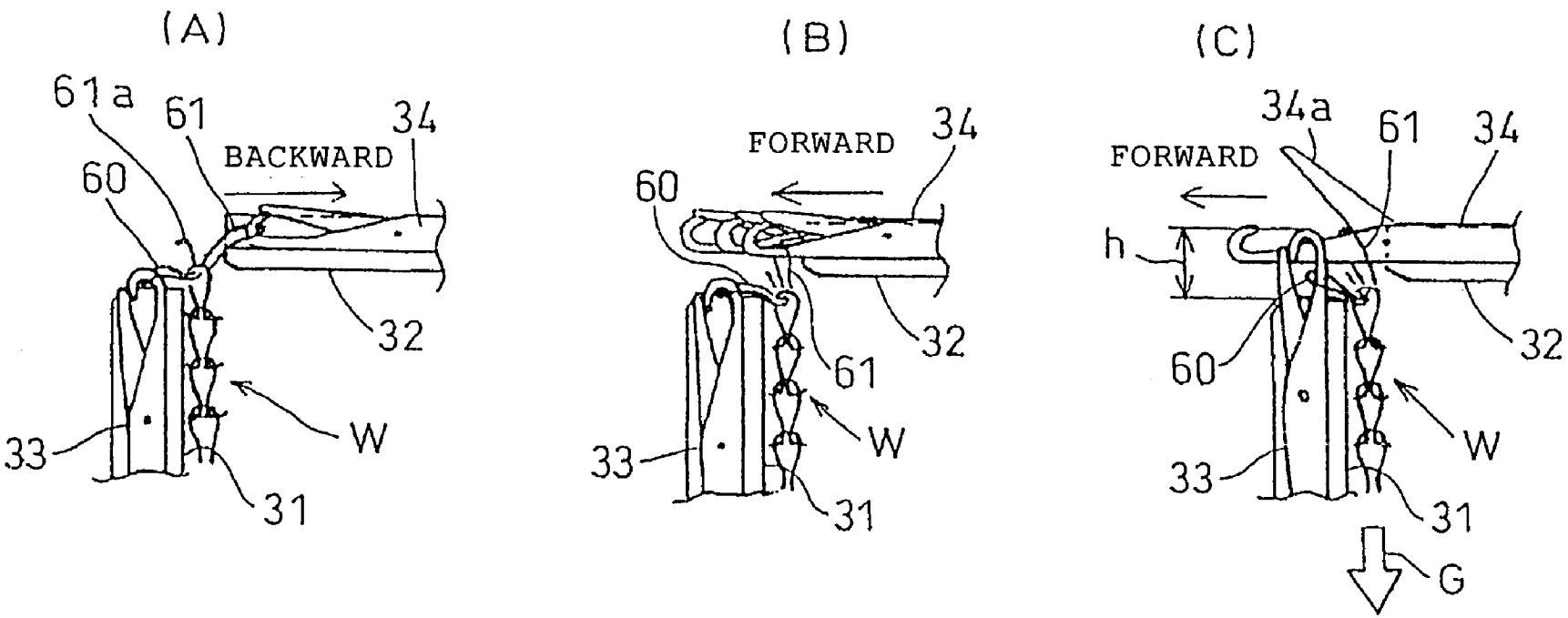
FIG. 9 is a motion diagram illustrating the operational relationship between a cylinder needle and a dial needle.

For describing the cam shape of the cylinder cam 36, motions of the cylinder needle 33 and the dial needle 34 shown in FIG. 9 will first be described. Referring to FIG. 9(A), the cylinder needle 33 holds a cylinder-side loop 60 that is the latest of those being knitted and stands by in a down position in which it does not project from the upper end of the cylinder 31. On the other hand, the dial needle 34 is in a state in which it has released a formed dial-side loop 61*a* and moved backward while holding the latest dial-side loop 61 being knitted. Referring to FIG. 9(B), the dial needle 34 has finished the backward movement and turned to forward movement. At that time, the cylinder needle 33 stands by in a down position in which it does not project from the upper end of the cylinder 31. Referring to FIG. 9(C), the dial needle 34 is in a state in which it continues the forward movement, and in which a latch 34*a* is opened, preparing to release the latest dial-side loop 61 being knitted (to pass through toward the back of the latch 34*a*).

From this state, the cylinder needle 33 exhibits a distinguishing motion. The cylinder needle 33 starts to rise in the process of the forward motion of the dial needle 34 to reach the floating position where the cylinder-side loop 60 is exposed from the upper end of the cylinder 31. At that time, the projecting amount h of the cylinder needle 33 from the upper end of the cylinder 31 is approximately 1 mm. From the point in time when the cylinder needle 33 has reached the floating position, the floating state is temporarily kept waiting.

Since the cylinder needle 33 floats at such timing, the cylinder-side loop 60 held by the cylinder needle 33 and the dial-side loop 61 held by the dial needle 34 are both relaxed, generating a motional allowance of the continuous fabric W itself. In other words, since the dial-side loop 61 becomes free from the motion of the dial needle 34, the dial-side loop 61 is not forced to be drawn therein and as such, it is relaxed. Accordingly, the entire continuous fabric W being knitted is given a downward drawing allowance.

When the continuous fabric W is then given a drawing action G toward the lower part of the cylinder 31 by the winder 39 (refer to FIG. 6), reliable knitting can be continued hereafter.

Figure 10:
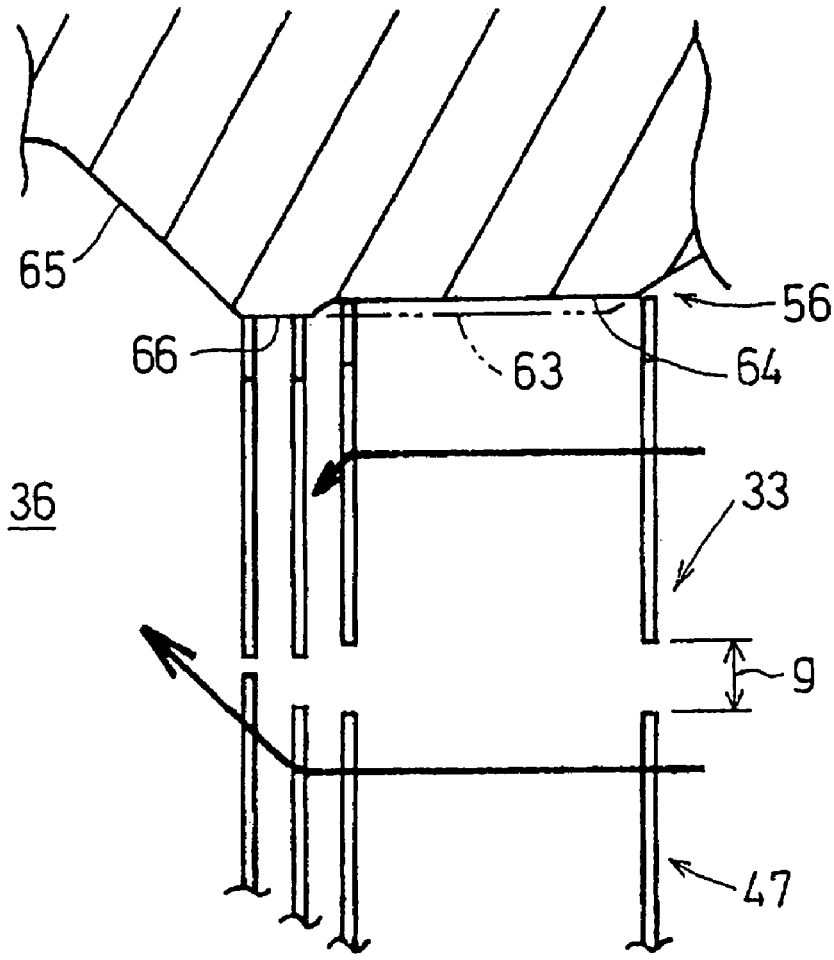
FIG. 10 is an enlarged diagram of part D in FIG. 7.

As is evident from the above description, the needle-operation control means 56 is constructed to apply the floating to floating-standby action to the cylinder needle 33, and employs a cam shape, shown by part D in FIG. 7 or in the enlarged view of FIG. 10, to achieve the cam shape of the cylinder cam 36.

Referring to FIG. 10, a part 63 indicated by the chain double-dashed line in the cylinder cam 36 has a conventional cam shape. The cylinder needle 33 is guided upward toward a floating standby position by a part 64 that is recessed upward from the part 63 indicated by the chain double-dashed line.

The cylinder needle 33 stands by in the floating state for a specified time and thereafter starts an upward motion for the following cycle (a slope indicated by numeral 65 in FIG. 10 is a part that guides the upward motion). At that time, it is preferable to temporarily move the cylinder needle 33 downward ahead of the starting of the upward motion.

The downward trapezoidal projection indicated by numeral 66 in FIG. 10 is a guide to move the cylinder needle 33 downward. The cylinder needle 33 is moved downward so as to return the jack 47 to specified downward position reliably. This is because, when the cylinder needle 33 is in the floating to floating standby mode, the cylinder needle 33 sometimes moves upward to a position where it is not pushed up by the jack 47 to cause a gap g therebetween.

The gap g is generated because of the shape and size of the cylinder cam 36 and the needle selection cam 50 in the lower cam block 35, which is not an inevitable result. However, when the cylinder needle 33 and the jack 47 are out of connection because of the gap g, a whirling motion may be generated in the jack 47 by running vibration, causing a vertical displacement of the jack 47.

In that case, when the cylinder needle 33 is temporarily moved downward with the downward trapezoidal projection 66, as described above, the jack 47 can be forced to be pushed down by the cylinder needle 33 and, as a result, the jack 47 can reliably be returned to a specified down position. This makes the subsequent motion of the jack 47 accurate.

The high-gauge circular knitting machine 30 including the needle-operation control means 56 allows the use of yarn that seems to be easy to break (thin yarn and weak easy-to-break yarn in terms of strength). Accordingly, the high-gauge circular knitting machine 30 can be equipped with the yarn-feeding changeover switch 45 and the needle selection system 46.

Since the high-gauge circular knitting machine 30 can use melt yarn to allow piece knitting with the isolation region C formed of the melt yarn, it can knit the continuous fabric W for the innerwear 1 according to the invention.

However, it is more preferable to adopt the following structure for the winder 39 when using thin yarn and easy-to-break weak yarn, and in particular, in addition to such natures of yarn, when using a small number of yarns for knitting as in forming the isolation region C with melt yarn. In short, a torque controller 70 is provided to the winder 39, as shown in FIG. 6.

The torque controller 70 is principally used to control the strength of the winding torque in accordance with the operating condition of the needle selection system 46. This may essentially differ from the conventional way of thinking to make the winding torque constant.

Specifically speaking, when the needle selection system 46 sets the number of the cylinder needles 33 for knitting small, the winding torque is decreased, and when it sets the number of the cylinder needles 33 for knitting large, the winding torque is increased. Such a control prevents yarn breakage particularly when the number of the cylinder needles 33 for knitting is small. The torque controller 70 can also control the winding torque to be decreased when thin yarn or easy-to-break weak yarn is selected by the operation of the yarn-feeding changeover switch 45.

The torque controller 70 is constructed such that a servo motor is used as the winding motor 42 or a clutch (not shown) such as a powder clutch is incorporated in the transmission means 43 to allow the remote control of the rotation torque of the winding roller 41, to process operation information from the needle selectors 48 of the needle selection system 46 with a controller 71, and to output the process result to the winding motor 42, the transmission means 43 and so forth.

The instructions to the needle selection system 46, such as which needle selector 48 should make what operation (how many cylinder needles 33 are to be operated), are based on the initial operation plan for the high-gauge circular knitting machine 30. Accordingly, a pattern control of the torque controller 70 can be made according to the operation plan.

Alternatively, a real time control such as a feedback control may be made according to actual process results that are obtained by sensing the operating condition of the needle selection system 46 (the needle selectors 48), the condition of the continuous fabric W being knitted, or the tension of the yarns S1 and S2 being fed by a sensor etc, and processing them by the controller 71.

Figure 11:
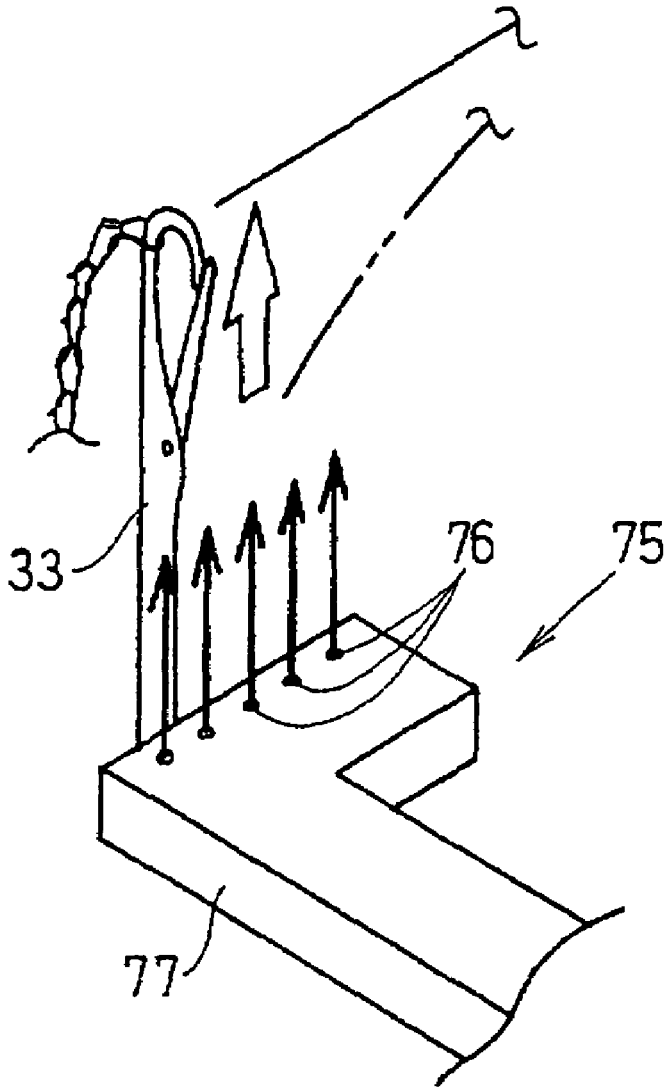
FIG. 11 is a perspective view of the principal part of a yarn-end processor.

FIG. 11 shows the principal part of a yarn-end processor 75 which is recommended to be disposed along the cylinder needle 33. The yarn-end processor 75 is used to interweave yarn ends inconspicuously within the knit fabric which are generated when the yarn in the yarn feeding device ends (not shown), when the yarns S1 and S2 are switched by the yarn-feeding changeover switch 45, or in case of yarn breakdown.

For this purpose, there is provided a structure in which air nozzles 77 having a plurality of air ports 76 disposed in parallel with the cylinder needles 33, the air ports blowing up air along the length direction of the cylinder needles 33, are disposed at regular intervals along the upper end periphery of the cylinder 31, and air is supplied to the air nozzles 77 during the operation of the high-gauge circular knitting machine 30.

As evident from the above description, in the knitting method using the high-gauge circular knitting machine 30 according to the invention, the yarns S1 and S2 to be fed toward the knitting position R can be changed as necessary in the process of knitting double-material cylindrical fabric with the vertically moving cylinder needles 33 and the dial needles 34 that move back and forth at a level that allows crossing the upper ends of the cylinder needles 33. When the cylinder needle 33 is on standby in down position in the process in which the dial needle 34 releases the formed dial-side loop 61*a* by backward motion and then moves forward, the cylinder needle 33 is moved upward to the floating position; when the cylinder needle 33 is in floating position at that point in time, the cylinder needle 33 is kept in the floating position.

Thus the cylindrical fabric being knitted is given a downward drawing allowance. This gives the cylindrical fabric itself a motional allowance (a relaxed state in which it is free from the motion of the dial needle 34), allowing cylindrical fabric without damage to be knitted with reliability and high efficiency. Also, since this allows the use of thin yarn and easy-to-break weak yarn, continuous fabric W for the innerwear 1 according to the invention can be knitted.

The invention is not limited to the foregoing embodiments, but may be modified as appropriate depending on the embodiments.

INDUSTRIAL APPLICABILITY

The invention is applicable usefully to bottom innerwear such as bottom wear, pants, spats, and shorts, and top innerwear such as camisoles and shirts. The invention is applicable usefully as a high-gauge circular knitting machine capable of knitting innerwear principally. However, the use for knitting outerwear is not excluded. The invention is applicable usefully to a knitting method using the high-gauge circular knitting machine.

The invention claimed is:

1. A high-gauge circular knitting machine that knits double-material cylindrical fabric comprising:

cylinder needles disposed around a cylinder so as to move vertically into and out from an upper circumference of the cylinder;

dial needles disposed on an upper surface of a dial on the cylinder so as to move back and forth into and out from an outer circumference thereof;

a yarn-feeding changeover switch that allows yarns fed to a knitting position between the cylinder needle and the dial needle to be changed during knitting; and needle-operation control means for keeping the cylinder needle temporarily waiting in a floating position in which the cylinder needle projects slightly from an upper end of the cylinder in a process in which the dial needle releases a formed dial-side loop by backward movement and then moves forward.

2. The high-gauge circular knitting machine according to claim 1, wherein the needle-operation control means adopts a cam shape that allows the cylinder needle to stand by in the floating position with respect to a cylinder cam disposed in the cylinder to control the vertical motion of the cylinder needle.

3. The high-gauge circular knitting machine according to claim 1, further comprising a needle selection system in which the cylinder needle is associated with a jack in a position facing the lower end of the cylinder needle, in which an upward movement and a height of an upper destination of the cylinder needle can be switched by varying vertical behaviors of the jack, wherein the needle-operation control means has a structure to keep the cylinder needle waiting in the floating position, and then temporarily move the cylinder needle downward ahead of start of an upward motion in a following cycle, thereby reliably returning the jack in position by the downward motion of the cylinder needle.

4. The high-gauge circular knitting machine according to claim 1, further comprising a needle selection system in which the cylinder needle is associated with a jack in a position facing the lower end of the cylinder needle, in which an upward movement and a height of an upper destination of the cylinder needle can be switched by varying vertical behaviors of the jack; and a winder that pulls down cylindrical fabric knitted in a knitting position between the cylinder needles and the dial needles to a lower part of the cylinder to wind it, wherein the winder includes a torque controller that varies a winding torque depending on an operating condition of the needle selection system.

5. A knitting method using a high-gauge circular knitting machine capable of changing yarns to be fed to a knitting position as necessary while knitting double-material cylindrical fabric with cylinder needles that move vertically and dial needles that move back and forth at a level that allows crossing an upper end of the cylinder needles, the knitting method comprising:

in the process in which the dial needle releases a formed dial-side loop by backward motion and then moves forward, when the cylinder needle stands by in a down position, the cylinder needle is temporarily moved upward to a floating position in which the cylinder needle projects slightly from an upper end of the cylinder, or when the cylinder needle is in the floating position, the cylinder needle is kept in the floating position, so that the cylindrical fabric being knitted is given a downward drawing allowance.

6. The high-gauge circular knitting machine according to claim 2, further comprising a needle selection system in which the cylinder needle is associated with a jack in a position facing the lower end of the cylinder needle, in which an upward movement and a height of an upper destination of the cylinder needle can be switched by varying vertical behaviors of the jack, wherein the needle-operation control means has a structure to keep the cylinder needle waiting in the floating position, and then temporarily move the cylinder needle downward ahead of start of an upward motion in a following cycle, thereby reliably returning the jack in position by the downward motion of the cylinder needle.

7. The high-gauge circular knitting machine according to claim 2, further comprising a needle selection system in which the cylinder needle is associated with a jack in a position facing the lower end of the cylinder needle, in which an upward movement and a height of an upper destination of the cylinder needle can be switched by varying vertical behaviors of the jack; and a winder that pulls down cylindrical fabric knitted in a knitting position between the cylinder needles and the dial needles to a lower part of the cylinder to wind it, wherein the winder includes a torque controller that varies a winding torque depending on an operating condition of the needle selection system.

* * * * *